United States Patent [19]

Bomar et al.

[11] 4,188,606

[45] Feb. 12, 1980

[54] PHASEABLE IMPEDANCE DEVICE

[75] Inventors: Richard L. Bomar, Riverside; Jesus Duarte, Pomona, both of Calif.

[73] Assignee: Bourns, Inc., Riverside, Calif.

[21] Appl. No.: 846,951

[22] Filed: Oct. 31, 1977

[51] Int. Cl.[2] ..... H01C 10/00

[52] U.S. Cl. ..... 338/137; 338/171; 338/202

[58] Field of Search ..... 338/135, 137, 160, 162, 338/171, 174, 185, 188, 190, 202; 29/593, 610

[56] References Cited

U.S. PATENT DOCUMENTS

| | | | |
|---|---|---|---|
| 2,195,813 | 4/1940 | DeGiers | 338/135 X |
| 2,403,989 | 7/1946 | Mallina | 338/174 |
| 2,551,989 | 5/1951 | Wilson | 338/202 X |
| 2,671,842 | 3/1954 | Collinson | 338/202 X |
| 3,187,288 | 6/1965 | Peters | 338/174 |

*Primary Examiner*—C. L. Albritton

*Attorney, Agent, or Firm*—Paul H. Ware; William G. Becker

[57] ABSTRACT

Mechanism and method for mounting at least a pair of wiper contact springs to a rotor such that the angular relationship between the two wiper contact springs may be very closely controlled. In one embodiment a first contact spring is permanently attached to a rotor, while a second contact spring is initially attached to the rotor by heat staking one end about a pivot point and placing the other end in a latch which holds the spring in place but permits it to be pivoted to some extent as desired. The rotor is then tested to determine the exact angular displacement between these contact springs. If the measured displacement is different from that desired, the second contact spring is pivoted to a corrected position and then cemented in place. Extension to more than a pair of contact springs is obvious.

9 Claims, 4 Drawing Figures

PHASEABLE IMPEDANCE DEVICE

BACKGROUND OF THE INVENTION

1. Field of the Invention

This invention relates generally to variable impedance devices and more particularly to multiple output variable impedance devices having means to adjust movable output means with respect to a first fixed output means.

2. Description of the Prior Art

Variable impedance devices are known in which the output therefrom is adjustable with respect to a particular positional setting of the impedance varying mechanism. In some of these prior art devices, a vernier-like mechanism has been employed to effect a "fine" positional setting after having made a "coarse" setting with a primary positioning means. In others, cam and cam follower arrangements have been employed to establish specific impedance values at specific positions of the impedance varying mechanism so as to make an impedance position repeatable without further adjustment.

These prior art devices, while effective in varying degrees for their purposes, do not contemplate the aims of the present invention. A novelty search conducted in the United States Patent and Trademark Office resulted in only one obtainable patent reference of possible relevance to the present invention. This U.S. Pat. No. 2,671,842 for Variable Electrical Impedance Components to R. F. Collinson, is, however, of questionable relevance since it teaches a single wiper and is designed to be used with wire-wound elements. The phasing contemplated is that of the mechanical positioning to the output function rather than one output function to another as taught by applicant's invention.

It would be a great advantage to the art to provide a multiple output variable impedance device capable of adjustment of one output with respect to others.

Another great advantage to the art would be the provision of such a device capable of precise adjustment of 90° phase difference of one output with respect to others.

An additional advantage to the art would be the provision of such a dual output variable impedance device capable of precise adjustment of 180° phase difference of one output with respect to another.

A further great advantage to the art would be the provision of such a device capable of precise adjustment to any desired phase angle difference of one output with respect to others.

It would be additionally advantageous to provide a device encompassing the above advantages in a simple and economically assembled structure.

SUMMARY OF THE INVENTION

It is an object of the present invention to provide a multiple output variable impedance device capable of adjustment of one output with respect to others.

It is another object of this invention to provide a device capable of precise adjustment to any desired phase angle difference of one output with respect to others.

It is a further object of the present invention to provide a device encompassing the above objects in a simple and economically assembled structure.

In the accomplishment of these and other objects, a variable impedance device is provided in which a first contact spring is attached to a rotor by means of heat staking and fixed in position so as not to be adjustable. A second contact spring is then attached to the rotor at a point by means of heat staking a pivot point and attachment by means of a latch. By pivotally moving the second contact spring around its pivot point, it can be placed in an exact phase angle relationship from the first contact spring. When the desired phase angle relationship between the two contact springs is attained, the second contact spring is cemented or otherwise secured in place.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings, wherein like reference characters refer to like parts throughout and in which.

DETAILED DESCRIPTION

Although specific embodiment of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
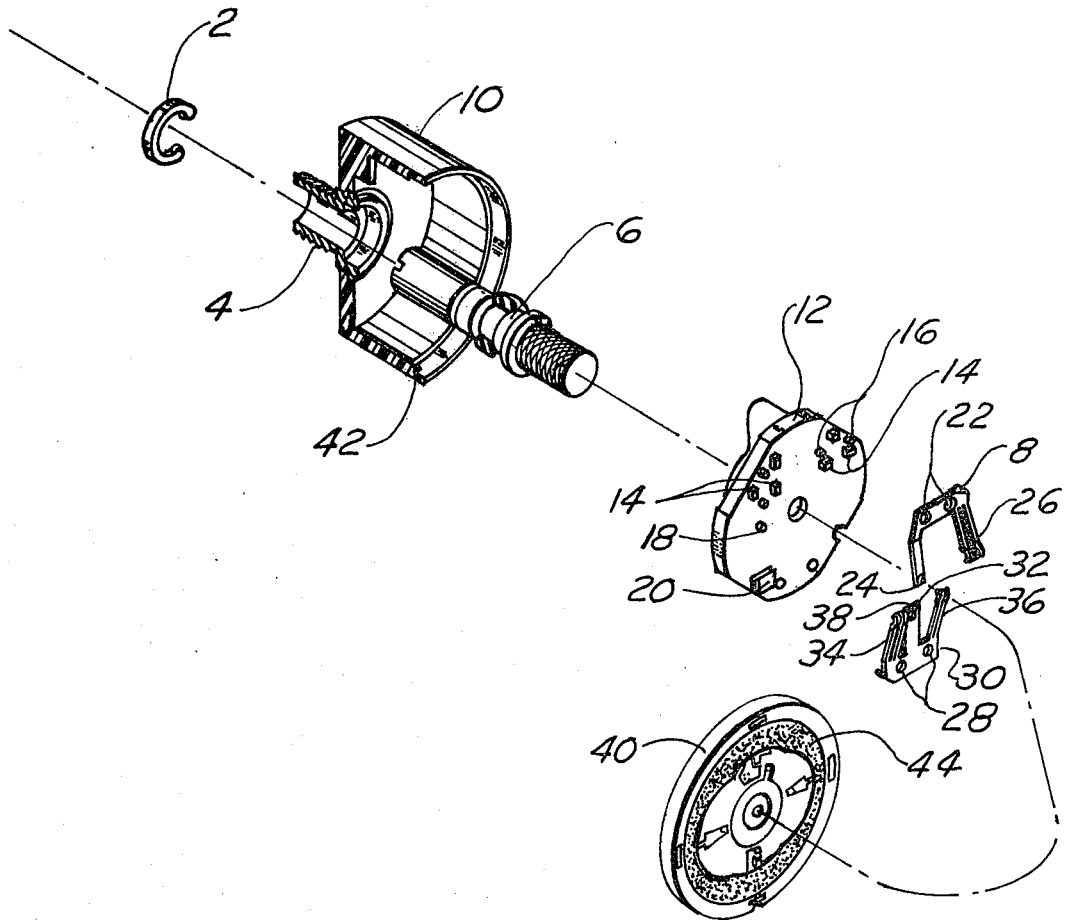
FIG. 1 is an exploded view of a device as contemplated by the invention.

Referring to FIG. 1 with greater particularity, there is shown a variable resistance device as contemplated by the invention. A housing or cover for the device is identified by the numeral 10 which retains a shaft 6 by means of bushing 4 and retaining ring 2. Shaft 6 has a knurled end that attaches to rotor 12 which carries locator and heat staking pegs 16 and heat staking patches 14 which accept locator holes 22 in fixed wiper contact spring 8. Fixed wiper contact spring 8 has formed as integral parts thereof first pick-off element contact 26 and first output contact 24. Fixed wiper contact spring 8 is located and fastened to rotor 12 by means of locator and heat staking pegs 16 and heat staking patches 14. Once located and heat staked, fixed wiper contact spring 8 is non-adjustable. Adjustable wiper contact spring 30 is located to pivot point heat staking peg 18 and latch 20 by means of locator holes 28. Adjustable wiper contact spring 30 has a pivot arm 38 which has a hole 32 which accepts pivot point heat staking peg 18. Adjustable wiper contact spring 30 is allowed pivotal motion in the plane of rotor 12 about pivot point heat staking peg 18 being retained in the plane of rotor 12 by means of latch 20. As illustrated in FIG. 1, there are shown two sets of locator and heat staking pegs 16 and heat staking patches 14. One set of these patches permits a 90° coarse phase positioning of fixed wiper contact spring 8 with adjustable wiper contact spring 30. Another set of heat staking pegs and patches as illustrated permits 180° coarse phase relationship between fixed wiper contact spring 8 and adjustable wiper contact spring 30. This first adjustment is a coarse adjustment to be made more accurate by pivotal adjustment of adjustable wiper contac spring 30. The location of pivot point heat staking peg 18 is critical to optimum operation of the device. The use of ten times scale overlay drawings, as is known in the art, representing the rotor 12 and the adjustable wiper contact spring 8 allows the empirical selection of a position for this peg so as to result in minimum tracking error of second pick-off element 34 with respect to an impedance element. In FIG. 1, an impedance element is exemplified by resistance element 44. The point selected is thus a critical point and the peg 18 formed thereon is called a critically positioned pivot point peg. When such fine adjustment of the phase relationship between fixed wiper contact spring 8 and adjustable wiper contact spring 30 has been effected, adjustable wiper contact spring 30 is then securely fastened into place. Adjustable wiper contact spring 30 has as integral members thereof a second output contact 36 and a second pick-off element contact 34.

An element substrate 40, such as may be contemplated by the invention, is shown carrying a resistance element 44. Locator peg 42 in the housing 10 is utilized during assembly with assembly location notch 46 (FIG. 2).

Figure 2:
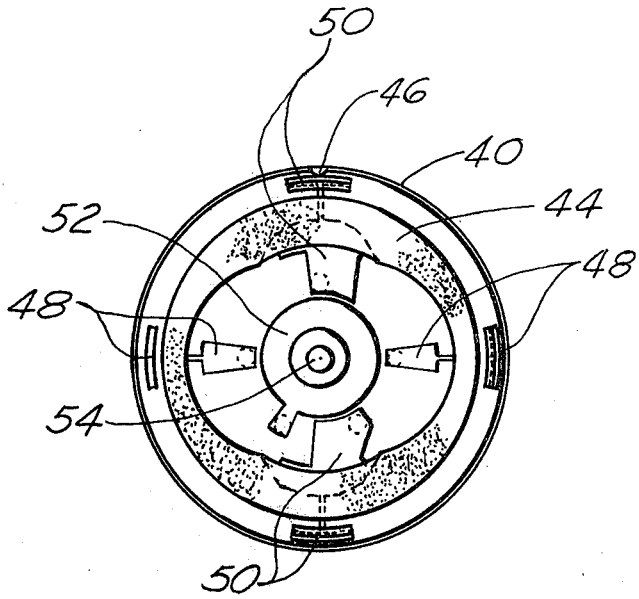
FIG. 2 illustrates an element substrate such as might be used with the invention in plan elevation.

Referring now to FIG. 2, details of element substrate 40 may be examined in greater detail. In the particular embodiment of the element substrate shown, there is illustrated a resistance element 44 formed on element substrate 40, with voltage taps 48 and current taps 50, as might be used in developing a desired functional output pair. Conventional collector ring 52 and collector terminal 54 as well known in the art are illustrated for completeness.

Figure 3:
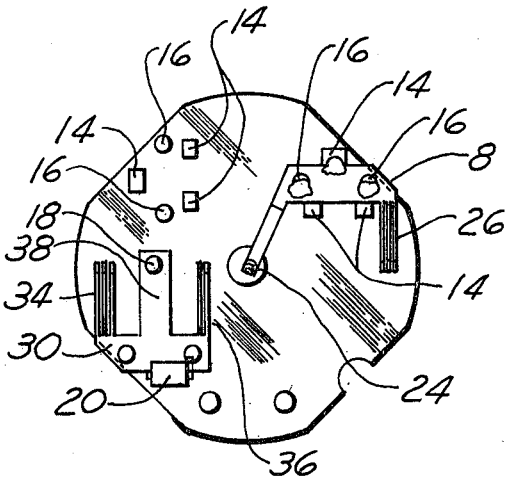
FIG. 3 is a detail plan view of an assembled rotor as contemplated by the invention.

Referring now to FIG. 3, fixed wiper contact spring 8 is shown in 180° phase relationship with adjustable wiper contact spring 30. Heat staking patches 14 and locator and heat staking pegs 16 are shown after heat staking so as to maintain fixed wiper contact spring 8 in fixed position. Fixed wiper contact spring 8 is shown as comprising its members first pick-off element contact 26 and first output contact 24. Additional locator and heat staking pegs 16 and heat staking patches 14 are shown without attachment of fixed wiper contact spring 8, but it is noted that this would be the position of attachment of fixed wiper contact spring 8 if a 90° phase relationship were required. Adjustable wiper contact spring 30 has been shown mounted by means of pivot hole 32 to pivot point heat staking peg 18 and held in place by means of latch 20. Limited pivotal movement of adjustable wiper contact spring 30 is allowable within the confines of latch 20 so as to effect fine adjustment of the phase angle relationship with fixed wiper contact spring 8. Adjustable wiper contact spring 30 is shown as comprising its pivot arm 38 which has a pivot hole 32, and second output contact 36 along with second pick-off element contact 34. It should be noted that locator and heat staking pegs 16 and heat staking patches 14 in sets could be fabricated in any desired coarse angular relationship with adjustable wiper contact spring attachment pivot means as desired.

Figure 4:
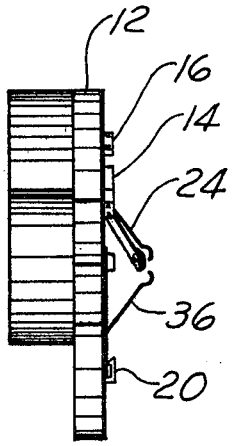
FIG. 4 is a side elevation of the rotor of FIG. 3.

FIG. 4 illustrates rotor 12 and locator and heat staking pegs 16 and heat staking patches 14 in a side elevational view. Also shown in FIG. 4 are the side elevational relationships between first output contact 24, second output contact 36, and latch 20.

Thus, there has been described a variable impedance device with phaseable wipers that will permit the attainment of a precise phase angle relationship between related outputs. Great improvements in reliability, flexibility, and ease of assembly have been provided through the novel advantages of the invention.

It is pointed out that although the present invention has been shown and described with reference to particular embodiments, nevertheless various changes and modifications obvious to one skilled in the art to which the invention pertains are deemed to lie within the purview of the invention.

What is claimed and desired to be secured by Letters Patent of the United States is:

1. In combination:

a rotor to be used with a variable impedance device;

a fixed wiper contact spring mounted upon said rotor;

at least a pair of locator and heat staking pegs formed on said rotor for positioning and fastening said fixed wiper contact spring thereto;

a plurality of heat staking patches for securing said fixed wiper contact spring to said rotor;

a first pick-off element contact member integral with and forming a part of said fixed wiper contact spring;

a first output contact member integral with and forming a part of said fixed wiper contact spring;

an adjustable wiper contact spring mounted upon said rotor;

at least one critically positioned pivot point heat staking peg formed on said rotor;

a pivot arm member, integral with and forming a part of said adjustable wiper contact spring, having an aperture to receive said at least one critically positioned pivot point heat staking peg and permitting small angular pivotal movement of said adjustable wiper contact spring about said at least one critically positioned pivot point heat staking peg;

a latch formed on said rotor so as to constrain pivotal movement of said adjustable wiper contact spring to the plane of said rotor;

a second output contact member integral with and forming a part of said adjustable wiper contact spring;

a second pick-off element contact member integral with and forming a part of said adjustable wiper contact spring; and means employing said latch, to fix the position of said adjustable wiper contact spring.

2. A variable impedance device comprising:

an element substrate having electrical impedance means formed thereon;

a rotor mounted in operative relation to said electrical impedance means;

at least a pair of pick-off elements mounted on said rotor, wherein at least one of said at least a pair of pick-off elements is a fixed wiper contact spring having locator holes formed therein and comprising:

a first pick-off element contact; and a first output contact; and wherein another of said pair of pick-off elements is an adjustable wiper contact spring having locator holes formed therein and comprising:

a second pick-off element contact;

a second output contact; and a pivot arm having a pivot hole formed therein;

first locating means to position a first of said pick-off elements to a predetermined location upon said rotor wherein said first locating means comprises at least one heat staking patch and locator and heat staking pegs for receiving said locator holes formed in said fixed wiper contact spring;

first fastening means to secure the first of said pick-off elements to said predetermined location;

second locating means to position succeeding ones of said pick-off elements to coarse predetermined locations with respect to said first of said pick-off elements upon said rotor;

fine adjustment means for effecting accurate angular phase difference locations upon said rotor between the first of said pick-off elements and succeeding ones of said pick-off elements; and second fastening means to secure said succeeding ones of said pick-off elements at said accurate angular phase difference locations.

3. A variable impedance device comprising:

an element substrate having electrical impedance means formed thereon;

a rotor mounted in operative relation to said electrical impedance means;

at least a pair of pick-off elements mounted on said rotor, wherein at least one of said at least a pair of pick-off elements is a fixed wiper contact spring having locator holes formed therein and comprising:

a first pick-off element contact; and a first output contact; and wherein another of said pair of pick-off elements is an adjustable wiper contact spring having locator holes formed therein and comprising:

a second pick-off element contact;

a second output contact; and a pivot arm having a pivot hole formed therein;

first locating means to position a first of said pick-off elements to a predetermined location upon said rotor wherein said first locating means comprises locator pegs for receiving said locator holes formed in said fixed wiper contact spring;

first fastening means to secure the first of said pick-off elements to said predetermined location wherein said first fastening means is a heat staking means;

second locating means to position succeeding ones of said pick-off elements to coarse predetermined locations with respect to said first of said pick-off elements upon said rotor;

fine adjustment means for effecting accurate angular phase difference locations upon said rotor between the first of said pick-off elements and succeeding ones of said pick-off elements; and second fastening means to secure succeeding ones of said pick-off elements at said accurate angular phase difference locations.

4. A variable impedance device comprising:

an element substrate having electrical impedance means formed thereon;

a rotor mounted in operative relation to said electrical impedance means;

at least a pair of pick-off elements mounted on said rotor, wherein at least one of said at least a pair of pick-off elements is a fixed wiper contact spring having locator holes formed therein and comprising:

a first pick-off element contact; and a first output contact; and wherein another of said pair of pick-off elements is an adjustable wiper contact spring having locator holes formed therein and comprising:

a second pick-off element contact;

a second output contact; and a pivot arm having a pivot hole formed therein;

first locating means to position a first of said pick-off elements to a predetermined location upon said rotor wherein said first locating means comprises at least one heat staking patch and locator and heat staking pegs for receiving said locator holes formed in said fixed wiper contact spring;

first fastening means to secure the first of said pick-off elements to said predetermined location wherein said first fastening means is a heat staking means;

second locating means to position succeeding ones of said pick-off elements to coarse predetermined locations with respect to said first of said pick-off elements upon said rotor;

fine adjustment means for effecting accurate angular phase difference locations upon said rotor between the first of said pick-off elements and succeeding ones of said pick-off elements; and second fastening means to secure said succeeding ones of said pick-off elements at said accurate angular phase difference locations.

5. A variable impedance device comprising:

an element substrate having electrical impedance means formed thereon;

a rotor mounted in operative relation to said electrical impedance means;

at least a pair of pick-off elements mounted on said rotor, wherein at least one of said at least a pair of pick-off elements is a fixed wiper contact spring having locator holes formed therein and comprising:

a first pick-off element contact; and a first output contact; and wherein another of said pair of pick-off elements is an adjustable wiper contact spring having locator holes formed therein and comprising:

a second pick-off element contact;

a second output contact; and a pivot arm having a pivot hole formed therein;

first locating means to position a first of said pick-off elements to a predetermined location upon said rotor wherein said first locating means comprises at least one heat staking patch and locator and heat staking pegs for receiving said locator holes formed in said fixed wiper contact spring;

first fastening means to secure the first of said pick-off elements to said predetermined location;

second locating means to position succeeding ones of said pick-off elements to coarse predetermined locations with respect to said first of said pick-off elements upon said rotor wherein said second locating means comprise a critically positioned pivot point peg and a latch;

fine adjustment means for effecting accurate angular phase difference locations upon said rotor between the first of said pick-off elements and succeeding ones of said pick-off elements; and second fastening means to secure said succeeding ones of said pick-off elements at said accurate angular phase difference locations.

6. A variable impedance device comprising:

an element substrate having electrical impedance means formed thereon;

a rotor mounted in operative relation to said electrical impedance means;

at least a pair of pick-off elements mounted on said rotor, wherein at least one of said at least a pair of pick-off elements is a fixed wiper contact spring having locator holes formed therein and comprising:

a first pick-off element contact; and a first output contact; and wherein another of said pair of pick-off elements is an adjustable wiper contact spring having locator holes formed therein and comprising:

a second pick-off element contact;

a second output contact; and a pivot arm having a pivot hole formed therein;

first locating means to position a first of said pick-off elements to a predetermined location upon said rotor wherein said first locating means comprises at least one heat staking patch and locator and heat staking pegs for receiving said locator holes formed in said fixed wiper contact spring;

first fastening means to secure the first of said pick-off elements to said predetermined location;

second locating means to position succeeding ones of said pick-off elements to coarse predetermined locations with respect to said first of said pick-off elements upon said rotor wherein said second locating means comprise a critically positioned pivot point peg and a latch, wherein said coarse predetermined locations include a right angle and a straight angle;

fine adjustment means for effecting accurate angular phase difference locations upon said rotor between the first of said pick-off elements and succeeding ones of said pick-off elements, wherein said fine adjustment means comprise a critically positioned pivot point peg formed on said rotor and a latch operable to constrain pivotal movement of said succeeding ones of said pick-off elements to small angles in the plane of said rotor; and second fastening means to secure said succeeding ones of said pick-off elements at said accurate angle phase difference locations.

7. A variable impedance device comprising:

an element substrate having electrical impedance means formed thereon;

a rotor mounted in operative relation to said electrical impedance means;

at least a pair of pick-off elements mounted on said rotor, wherein at least one of said at least a pair of pick-off elements is a fixed wiper contact spring having locator holes formed therein and comprising:

a first pick-off element contact; and a first output contact; and wherein another of said pair of pick-off elements is an adjustable wiper contact spring having locator holes formed therein and comprising:

a second pick-off element contact;

a second output contact; and a pivot arm having a pivot hole formed therein;

first locating means to position a first of said pick-off elements to a predetermined location upon said rotor wherein said first locating means comprises at least one heat staking patch and locator and heat staking pegs for receiving said locator holes formed in said fixed wiper contact spring;

first fastening means to secure the first of said pick-off elements to said predetermined location wherein said first fastening means is a heat staking means;

second locating means to position succeeding ones of said pick-off elements to coarse predetermined locations with respect to said first of said pick-off elements upon said rotor wherein said second locating means comprise a critically positioned pivot point peg and a latch, wherein said coarse predetermined locations include a right angle and a straight angle;

fine adjustment means for effecting accurate angular phase difference locations upon said rotor between the first of said pick-off elements and succeeding ones of said pick-off elements, wherein said fine adjustment means comprise a critically positioned pivot point peg formed on said rotor and a latch operable to constrain pivotal movement of said succeeding ones of said pick-off elements to small angles in the plane of said rotor; and second fastening means to secure said succeeding ones of said pick-off elements at said accurate angular phase difference locations.

8. A method of obtaining desired phase relationships between at least two signal outputs of a variable impedance device comprising the steps of:

mounting a first pick-off element contact spring in a fixed position on a rotor to be used with said variable impedance device;

determining a critical pivot point and locating a critical pivot point peg at said critical pivot point;

mounting a second pick-off element contact spring pivotably on said rotor by means of said critical pivot point peg in an approximate desired phase relationship as determined by the mounting of said first pick-off element contact spring;

adjusting said second pick-off element contact spring about said critical pivot point peg to an accurate desired phase relationship with said first pick-off element contact spring;

fixing said second pick-off element contact spring to said accurate desired phase relationship; and attaching said rotor to said variable impedance device.

9. The method of claim 8, wherein fixing said second pick-off element is accomplished by heat staking.

* * * * *